United States Patent [19]

Canevazzi et al.

[11] Patent Number: 4,887,988

[45] Date of Patent: Dec. 19, 1989

[54] METHOD FOR THE MOUNTING OF A SHADOW MASK IN A TRICHROMATIC CATHODE TUBE AND CATHODE TUBE COMPRISING A SHADOW MASK MOUNTED ACCORDING TO THIS METHOD

[75] Inventors: Giuliano Canevazzi, Grottaferrata; Paul Spina, Ferentino, both of Italy

[73] Assignee: Videocolor, Montrouge, France

[21] Appl. No.: 147,901

[22] Filed: Jan. 25, 1988

[30] Foreign Application Priority Data

Jan. 27, 1987 [FR] France ..... 87 00932

[51] Int. Cl.[4] ..... H01J 9/236

[52] U.S. Cl. ..... 445/37; 445/30; 445/52

[58] Field of Search ..... 445/30, 37, 52, 4; 29/447, 448; 313/482

[56] References Cited

U.S. PATENT DOCUMENTS

| | | | |
|---|---|---|---|
| 2,625,734 | 1/1953 | Law | 29/25.13 |
| 3,493,356 | 2/1970 | Torrence | 445/30 |
| 3,894,321 | 7/1975 | Moore | 445/30 |
| 4,069,567 | 1/1978 | Schwartz | 29/25.15 |
| 4,591,344 | 5/1986 | Palac | 445/52 |
| 4,652,791 | 3/1987 | Palac et al. | 445/30 |
| 4,721,488 | 1/1988 | Dougherty | 445/30 |

FOREIGN PATENT DOCUMENTS

| | | | |
|---|---|---|---|
| 0121628 | 10/1984 | European Pat. Off. | 445/30 |
| 0050739 | 3/1982 | Japan | 445/30 |
| 0157139 | 8/1985 | Japan | 445/37 |
| 61-80735 | 4/1986 | Japan . | |

*Primary Examiner*—Kurt Rowan

*Attorney, Agent, or Firm*—Oblon, Spivak, McClelland, Maier & Neustadt

[57] ABSTRACT

A method for the mounting of a shadow mask in a trichromatic cathode tube pertains especially to the mounting of the mask on a frame. The shadow mask has a perforated, plane active surface which must be held under sufficient mechanical tension, so that it preserves its planarity during the functioning of the tube. The method consists in increasing the dimensions of the active surface, either by heating it to expand it or by stretching it mechanically to give it the desired mechanical tension, and then in soldering the mask to a sufficiently rigid frame to maintain the active surface in its state of mechanical tension.

16 Claims, 4 Drawing Sheets

METHOD FOR THE MOUNTING OF A SHADOW MASK IN A TRICHROMATIC CATHODE TUBE AND CATHODE TUBE COMPRISING A SHADOW MASK MOUNTED ACCORDING TO THIS METHOD

BACKGROUND OF THE INVENTION

1. Field of the Invention

The invention pertains to a method for mounting a shadow mask of the flat, perforated type (known as a flat tension mask) in a trichromatic cathode tube. It pertains especially to a method for the mechanical tensioning of the mask so that it preserves its planarity while functioning. The invention also pertains to a trichromatic cathode tube comprising a shadow mask that is mounted according to this method.

2. Description of the Prior Art

At present, color television manufacturers are directing their production efforts so as to obtain images on surfaces that are as flat as possible, i.e. their aim is that the front panel or envelope of the color television picture tube should be as flat as possible. Manufacturers are capable of producing glass front envelopes that are entirely flat (both externally and internally) and of optimizing the geometry of these envelopes with a view to providing, in particular, protection against implosion. Thus, the main limitations on the use of flat screens are related to the requirements of mounting the shadow mask which, in this case, should also be flat.

The shadow mask constitutes a color selection electrode which, until quite recently, was curved or parabolic in order to obtain an image on an envelope which was also curved. A trichromatic cathode ray tube or color television tube generally comprises a glass casing consisting of a rectangular-shaped front panel or front envelope, often extended by a skirt-shaped lateral wall. The skirt is sealed to a conical part which is narrowed and ends in a tubular or cylindrical neck. The said neck houses a set of three guns at its end. It has electromagnetic deflectors tightly fitted on to its exterior. These deflectors are used to scan a trichromatic luminescent screen. The screen consists of luminophors of three primary colors, red, blue and green, which are deposited on the internal surface of the front envelope. The luminophors are made up of either dots or vertical lines arranged, for example, in a repeated succession of three strips of vertical luminophors of different colors (red, green and blue). The selection of the colors is obtained by a selection electrode known as a shadow mask which is placed on the path of the electron beams which have to bombard the screen. The shadow mask consists of a metallic surface having a shape similar to that of the screen, which is usually domed. Most often, the shadow mask is of the perforated type, namely its surface is pierced with a large number of holes (for example, oblong or rectangular holes), the purpose of which is to let through, for each electron beam, only that part of the beam which will bombard the line or luminophor of the color assigned to this beam.

The curvature of the shadow mask is generally obtained by mechanical shaping operations which increase its mechanical resistance and make it possible to mount it easily, by welding, on a frame which is also domed. The domed shadow mask and the frame constitute an assembly that has great mechanical rigidity making it compatible with batch manufacturing conditions and capable of withstanding handling operations as well as shocks and vibrations.

During the manufacture of the tube, the shadow mask/frame assembly has to be lifted and repositioned several times, especially to make the trichromatic screen.

It must be noted that the perforated mask, and especially its active surface which has the perforations, dissipates a major part of the power of the electronic beams by Joule effect. The result of this is an expansion of the perforated mask which may result in a doming of the mask that modifies the initial alignment between certain perforations of the mask and the luminophors. The result of this is either a decrease in the light intensity proportionate to the surface of the bombarded luminophors or color purity faults. These faults are reduced by the use of a perforated mask with a radius of curvature that is smaller than that of the screen according to method known as the super arched mask method. The expansion of the perforated mask constitutes a limit on the power density (W/cm2) which can be applied by scanning frames.

As compared with a curved screen working with a shadow mask that is also curved, the use of an perforated type of flat mask (known as a flat tension mask or an FTM) provides numerous advantages, for example:

Power density of more than 100 mW/cm2 for a full scanning frame, i.e. about eight times greater than a curved perforated mask;

The possibility of using a perfectly flat screen for both 90° and 110° deflections;

The possibility of being used in a very wide range of applications and in every size, especially for high-definition color picture tubes, possibly for special military applications.

The only possibility of using a flat tension mask is that it should be mounted on a relatively solid frame putting it under adequate mechanical tension so that, during operation, its heating under the bombardment effect of the electron beams does not destroy its planarity.

An approach of this type has been used within the framework of a color-tube manufacturing method which is appreciably different from usual manufacturing methods. In this method, a screen (not flat) with the shape of a cylindrical portion is coupled to a mask known as a grid mask and the holes are replaced by heightwise vertical slits on the screen. Metallic strips forming this mask are mounted on a solid frame between two opposite curved arms of this frame so that they are parallel to a first axis Y, corresponding to the height of the screen, which has a smaller dimension than the said screen. The strips are rectilinear and very highly tensioned on the frame along the first direction Y and the frame should be very solid to keep the mask under tension along this direction Y.

With the flat tension mask (FTM), the problem is different inasmuch as it has to be subjected to mechanical tension which is uniform in all directions.

There is a prior art method for mounting a flat tension mask on a frame to obtain mechanical tension of the mask along the first axis Y and along a second axis X perpendicular to the first axis. For this purpose, the prior art method consists in joining the periphery of the metallic flat tension mask to a glass frame by a welding operation in which the flat tension mask and the glass frame are heated to about 400°. The flat mask is held on the glass frame by a removable tool while the assembly is being cooled. As the expansion coefficient of the metallic flat tension mask is greater than that of the glass frame, after the assembly is cooled, the flat mask is mounted in mechanical tension on the glass frame. One of the disadvantages of this method is that the glass frame is relatively brittle in itself and must have a cross-section which is large enough to give it the mechanical sturdiness needed to bear the mechanical tension of the flat tension mask, and also to withstand any shocks which may occur during the many subsequent operations for handling the frame/flat mask assembly. Consequently, the frame is very bulky and this considerably complicates its mounting in the tube. In this prior art method, this mounting is done by welding the frame on one side of the rear of the envelope and by welding it on the other side against the flared end of the glass forming the tube. The frame thus forms a part of the tube wall between the envelope and the glass of the tube.

Another disadvantage of this mounting is that it also complicates the operations for positioning the frame/-mask to make the screen. For the positioning means that are then used should make it possible to place the frame/mask assembly in the same position as the one that will be occupied by this assembly when it is finally fixed. Now, since the final fixing of the assembly is done by welding, it is seen that the means used for the positioning and final fixing of the frame/mask assembly are not the same as those used to position and hold this assembly to make the screen. It must be further noted that the final assembly of the frame/mask assembly requires the use of very complicated, special-purpose tools in a complicated and expensive operation during which the entire tube and these tools are placed in a furnace to fix the frame by welding at a temperature of more than 400°. Furthermore, in this frame welding operation, the mask itself is heated to a high temperature so that it is again expanded as it was during its mounting on the frame, so that there is a risk of variation in the mechanical tension of the mask and a risk of variation in its position with respect to the screen.

SUMMARY OF THE INVENTION

The present invention pertains to a method for the mounting of a shadow mask of the flat tension type in a cathode tube wherein the mask can be mounted with mechanical tension which is uniform in all directions and is adjusted far more precisely and more reliably than in the prior art. The method of the invention is simple to use and provides for easier handling and correct positioning of the mask with respect to the screen during both the stage for making the screen and the stage for the final fixing of the mask in the tube.

The invention also pertains to a trichromatic cathode tube comprising a shadow mask mounted according to this method.

An object of the invention is a method for mounting a shadow mask in a trichromatic cathode tube, the mask being of the flat perforated type designed to be held under mechanical tension, a method wherein the mask is fixed to a frame and then the mask/frame assembly is mounted in the tube by fixing the frame on a front envelope of the tube and wherein to mount the mask on the frame, the said mask is temporarily deformed to increase an active surface of the mask, then the mask is placed on the frame and fixed to the frame in its elongated state by welding so that the said mask is held by the frame in a state of mechanical tension.

BRIEF DESCRIPTION OF THE DRAWINGS

The invention will be better understood from the following example, given as a non-exhaustive example and made with reference to the six appended figures, of which.

DETAILED DESCRIPTION OF THE PREFERRED EMBODIMENT

Figure 1:
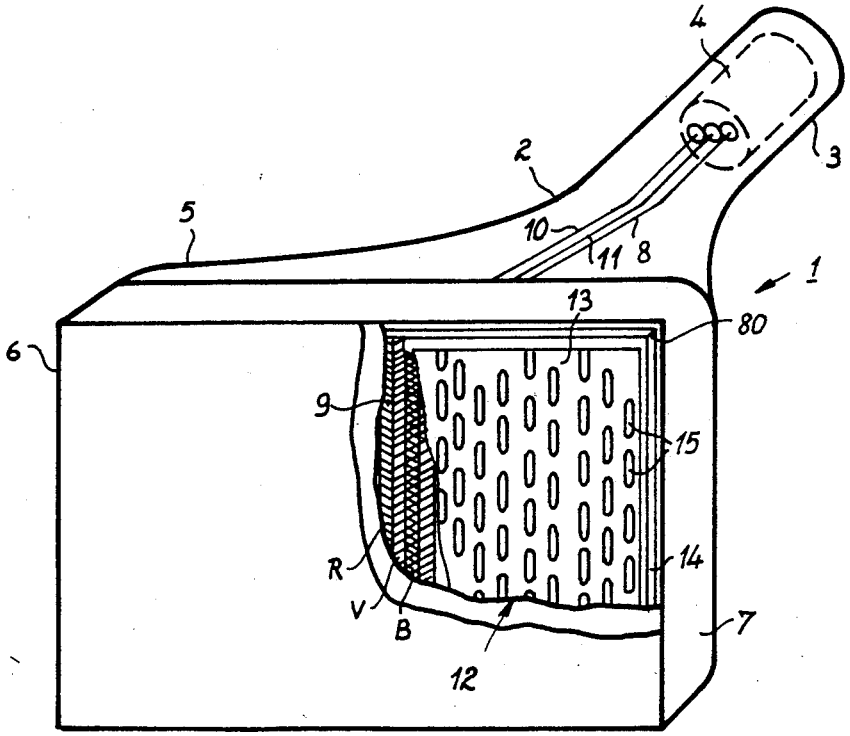
FIG. 1 is a partially cutaway perspective view that schematically depicts the general configuration of a trichromatic cathode tube.

FIG. 1 shows a non-limiting example of a cathode tube 1 designed to reproduce color television images. The tube 1 comprises a glass casing, one end of which finishes in a tubular neck 3 in which is housed a set of three electron guns 4. Opposite to the tubular neck 3, the casing 2 is flared out to form a conical part 5 which is joined with a front panel or front envelope 6 made of glass. In the non-exhaustive example described, the envelope 6 has a skirt 7, also made of glass, which forms a peripheral part of the tube 1 to which the conical part 5 of the casing 2 is fixed.

The envelope 6 has a screen 9 on an internal plane surface. The screen 9 is designed, in a conventional way, to be illuminated under the impact of three electron beams 10, 11, 8 emitted by the guns 4. The screen 9 is formed, in a manner known per se, by luminophors of three primary colors, red, blue and green. In the non-limiting example described, the screen 9 consists of a repeated succession of three vertical strips of luminophors of different colors, red, blue and green. The colors are selected by means of a shadow mask 12 placed in the path of the three electron beams, near the screen 9 and substantially parallel to it. The mask 12 is of the flat tension mask type and has an active surface 13 in which there are openings 15. In the non-limiting example shown in FIG. 1, the openings 15 are oblong shaped but they could, within the spirit of the invention, have a different shape (circular for example).

The mask 12 is borne by a metallic frame 14 which is itself fixed to the skirt 7 of the envelope 6 by fastening elements (not shown in FIG. 1) located at the corners 18 of the frame 14. The mask 12 has the effect of letting through each opening 15 only that part of the electron beams which is directed towards the red, green or blue luminophor strip assigned to it. The selection is due to the fact that the electron beams have different angles of incidence at the openings 15. As explained in the introduction, the relative position of the openings 15 with respect to the red, blue and green luminophor strips is of major importance. It is important to such an extent that these luminophor strips are positioned on the screen 9 by using the mask 12 with which the tube 1 has to be fitted. Subsequently, the assembly formed by the frame 15 and the mask 12 should be placed in front of the screen and removed several times, and the relative position between the screen 9 and the mask 12 should not be modified during any of these operations and should be preserved after the sealing of the tube 1. Since the screen 12 of the flat tension type (FTM), it is held before the screen 9 under mechanical tension which compensates for the expansions of the mask 12 and, more precisely, the expansions of the active surface 13 caused by its heating, and which prevents modifications of its position with respect to the screen 9. The heating of the mask 12 is caused, as explained above, by the fact that the major part of the electrons is absorbed by the mask.

Figure 2:
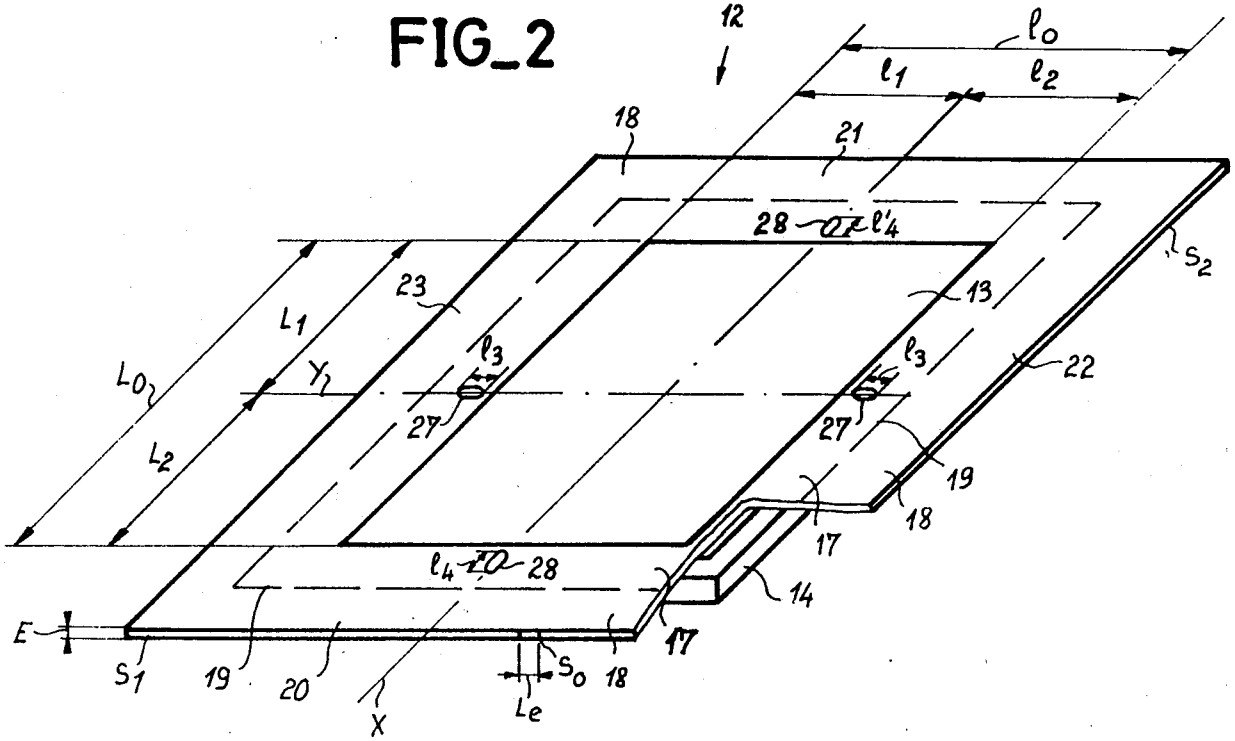
FIG. 2 is a schematic perspective view of a flat tension mask shown in FIG. 1, designed to be fixed on a frame.

FIG. 2 shows the flat type mask 12 before it is fixed to the frame 14.

Since the mask 12 has been made out of a sheet of steel by a method that is conventional per se, it comprises firstly, the active surface 13 in which the openings 15 (not shown in FIG. 2) are formed and, secondly, around its active surface, a first strip and second strip 17, 18. These two strips 17, 18 are made out of the same sheet of steel as the active surface 13, and have the same thickness E (approximately 0.025 mm.) as the said active surface 13 in the non-limiting example described. The first strip 17, which directly surrounds the active surface 13, is designed to be welded to the frame 14 and a second strip 18 or external strip is designed to enable the mask 12 to be handled before it is fixed to the frame 14. The external strip 18 is designed to be detached. It may be separated from the first strip 17 by means of a line 19 of perforations.

In the non-limiting example described, the mask 12 or, more precisely, the active surface 13 is flat and has a rectangular shape with a length Lo of 200 mm. and a width lo of 160 mm. To give mechanical tension to the active surface 13, the method of the invention lies in increasing the active surface 13 in a substantially uniform way by a temporary deformation of the active surface 13 wherein the active surface preserves its elasticity.

By a temporary deformation of the active surface 13, we mean a deformation such that the following results may be obtained:

Either a uniform expansion of the active surface 13 obtained by heating the said active surface;

Or a first mechanical pull exerted on two first opposite sides 20, 21 of the external strip 18 so as to elongate the active surface 13 along a first axis X, parallel to the length Lo, and another pull exerted on the second two opposite edges, 22, 23 of the external strip 18 so as to elongate the active surface 13 along a second axis Y parallel to the width lo. The increase in the surface 13 should remain within the limits of an elastic deformation according to criteria which are well known per se to the specialist.

Since the active surface 13 is in its state of temporary deformation, the mask 12 is then placed on the frame 14 so that the first strip 17 faces the said frame 14 so that the mask 12 can be fixed by welding the first strip 17 to the frame 14. In the non-exhaustive example described, the first strip 17 has notches or holes 27, 28 which form a first part of the means used to position the mask 12 with respect to the frame 14. As will be explained in greater detail further below in the description with reference to FIG. 3, the holes 27, 28 are designed to work in cooperation with other means such as, for example, positioning rods (not shown in FIG. 2) engaged in these holes 27, 28. But it must be understood that the positioning of the mask 12 can be obtained in other ways, known per se to the specialist. These other ways may entail, for example, the use of different mechanical means or optical means (not shown). Similarly, there may be any number of holes 27, 28 and the holes may be in any position and may have a cross-section of any shape, provided that it is suited to the other means with which the holes 27, 28 have to work in cooperation. In the non-limiting example shown in FIG. 2, two first holes 27, formed in the first strip 18, close to the active surface 13, are placed on either side of the active surface 13 along the second axis Y which divides the length Lo of the active surface 13 into two equal parts L1, L2. Two second holes 28 are set on either side of the active surface 13, along the first axis X which divides the width lo of the active surface 13 into two equal parts 11, 12. In the non-limiting example described, where the positioning holes 27, 28 are designed to receive positioning rods, and in order to enable the elongation of the active surface 13 simultaneously along the two axes X, Y during its temporary deformation, the positioning holes 27, 28 are oblong shaped. The length 13 of the first positioning holes 27 is placed along the second axis Y and the length 14 of the second positioning holes 28 is placed along the first axis x. Of course, the oblong shape of the holes 27, 28 is not obligatory, especially if the positioning rods engaged in the holes for the positioning of the mask 12 are retracted after the said mask has been positioned.

The mechanical tension to be given to the mask 12 should enable the latter to preserve its planarity despite the heating to which it is subjected during operation. In other words, this mechanical tension or prior tension should cause an increase in the active surface 13 at least equal to the increase which would result from the heating of the active surface 13 during operation.

Assuming that the heating during the operation of the active surface 13 is uniform, its relative elongation is the same along both axes X, Y. For an increase ΔL of the initial length Lo, the ratio between this increase ΔL and the initial length Lo gives the relative elongation ΔL/Lo. Subsequently, it is possible to determine the prerequisite mechanical tension to be given to the active surface 13, by knowing, for example, the relative elongation ΔL/Lo which has to be compensated for along the second axis Y, namely along the length Lo of the active surface 13.

The mechanical tension $\sigma$ given to the active surface 13 is expressed in kg/mm2. The mechanical tension $\sigma$ is equal to F/A, where F is the force in kilograms and A is the cross-section S1, S2 of the active surface 13 in mm2.

The value of the mechanical tension $\sigma$ is given by the following basic relationship:

$$\frac{F}{A} = E \cdot \frac{\Delta L}{Lo} \quad (1)$$

where E is Young's modulus in kg/mm2 and ΔL/Lo is the relative elongation mentioned above. F/A has already been defined above.

The relative elongation ΔL/Lo may be known from the following second expression:

$$\frac{\Delta L}{Lo} = \alpha \cdot \Delta T \quad (2)$$

where $\alpha$ is the expansion coefficient and $\Delta T$ is the temperature variation in degrees C.

Thus, for example, in the case of the mask 12 made out of a sheet of steel: the expansion coefficient $\alpha$ is equal to $1.2.10^{-5}$° C.$^{-1}$. The initial length Lo of the active surface 13 is 200 mm. Young's modulus E is equal to $2.1.10^4$ kg/mm2. If the temperature of the mask 12 and, especially, that of the active surface 13 is raised by 200° C., it is found, by applying the relationships 1 and 2 referred to above, that the mechanical tension $\sigma$ is equal to 50 kg/mm2.

Taking an elementary surface $S_0$ of the section S1, S2 of the mask 12, formed by the thickness E of the mask 12 and by an elementary width Le of 1 mm. parallel to the plane of the mask 12, it is possible to define a new value of mechanical tension $\sigma'$ which is expressed in kilograms per linear mm of thickness E.

Thus, in the case of the mask 12 with an initial length Lo of 200 mm. and a thickness E of 0.025 mm., the second value $\sigma'$ for a temperature variation $\Delta T$ of 200° C. is 1.25 kg/mm. The following table indicates, for various values of heating $\Delta T$ in degrees C., the corresponding values of relative elongation $\Delta L/Lo$, of elongation $\Delta L$ in mm. and mechanical tension $\sigma'$ expressed in kg/mm.

| Δ T (°C.) | Δ L/Lo | Δ L (mm) | $\sigma'$ (Kg/mm$_{linear}$) |
|---|---|---|---|
| 100 | 0,00125 | 0,24 | 0,6 |
| 200 | 0,0025 | 0,50 | 1,25 |
| 300 | 0,0036 | 0,75 | 1,8 |
| 400 | 0,005 | 1,00 | 2,4 |

Referring to the above table, it is seen that while the expected temperature rise during operation is 100° C., this rise in temperature $\Delta T$ may cause an elongation $\Delta L$ of 0.24 mm in the initial length Lo. If it is desired that the mechanical tension $\sigma'$ of the mask 12 should largely compensate for this expansion, it may be chosen to give the mask 12 a mechanical tension $\sigma$ of 1.25 kg./mm., the effect of which will be to increase the initial length Lo by 0.50 mm. This can be done by raising the temperature of the active surface 13 by 200° C. to obtain its temporary deformation, and by welding the mask 12 in this state to the frame 14. It is also possible to heat the mask 12, especially the active surface 13, and to weld the mask 12 to the frame 14 when it is observed that the initial length Lo has increased by 0.50 mm.

It must be noted that the method according to which the mechanical tension of the mask 12 is obtained by measuring the elongation of its dimensions is especially worthwhile because of the precision that it gives when the temporary deformation of the mask 12 results from mechanical pull, as explained earlier, as well as when it results from a heating of the active surface 13.

Figure 3:
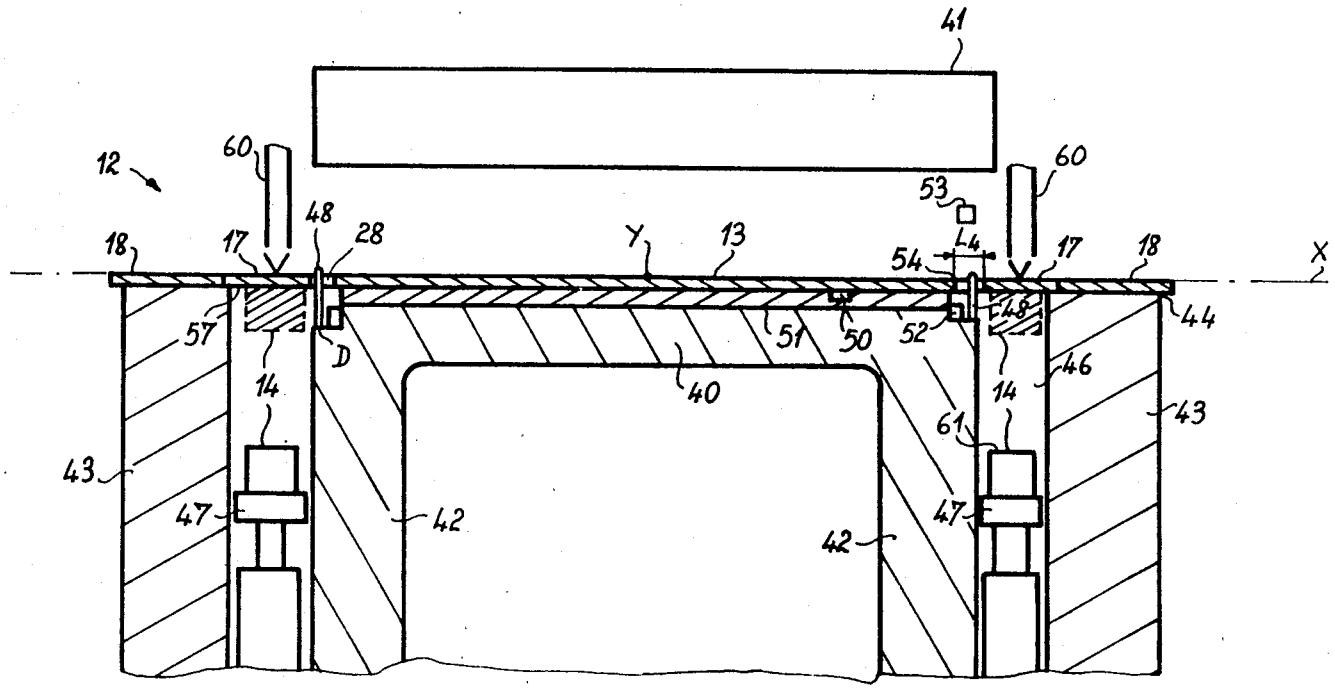
FIG. 3 is a schematic cross-section illustration of the fixing of the mask on the frame in a first embodiment of the method of the invention.

FIG. 3 illustrates a stage in the invention wherein the mask 12 is put into a state of temporary deformation by heating and then fixed to the frame 14 by welding.

The mask 12, which is shown in a cross-section along a first axis X for example, is placed on a support 40 borne by vertical columns 42 and made, for example, of a material that is a poor conductor of heat. A heating device 41 of the type that produces thermal radiation for example, is placed above the mask 12, especially above the active surface 13. The plane of this active surface 13 is supported by the support 40. It must be noted that the mask 12 can also be heated by different methods. For example, the device 41 may be of the type that has one coil or coils (not shown) to heat the mask 12 by induction according to a method which is conventional per se. The device 41 may then be placed above as well as beneath the mask 12.

The external strip 18 is supported on second vertical columns 43, an upper end 44 of which is in the same plane as the support 40. Between the first and second vertical columns 42, 43, a space 46 is formed. In this space the frame 14 is supported by jacks 47. The space 46 faces the first strip 17 which surrounds the active surface 13.

In the non-limiting example described, the mask 12 is positioned by placing it on the support 40 so that the vertical positioning rods 48, borne by the support 40, penetrate the second positioning holes 28 set along the axis X and already shown in FIG. 2. Two other vertical positioning rods, not shown in FIG. 3, are simultaneously engaged in the first positioning holes 27, shown in FIG. 2, set along the second axis Y. As the second axis Y is perpendicular to the plane of the FIG. 3, it is represented as a point on FIG. 3. The diameter D of the positioning rods 48 is smaller than the length 14 of the holes 28 so that the positioning rods 48 leave the active surface 13 completely free to extend on either side of each of the axes X and Y under the effect of the heating of the active surface 13 by the heating device 41. But as mentioned earlier, the rods 48 can be retracted after the mask 12 is positioned so that the holes 28 may not have an oblong shape.

The elongation of the active surface 13 needed to obtain the desired mechanical tension may be known in different ways:

either by indirect testing, for example, following tests during which the following are determined: firstly, the time for which the active surface 13 has to be heated and, secondly, the thermal power that the heating device 41 must radiate to carry the active surface 13 to the desired temperature;

or by direct testing, for example by placing one or more temperature sensors 50 in contact with the active surface 13, or again by incorporating the temperature sensor 50 in a metallic plate 51 placed on the top of the support 40. It must be noted that the plate 50 may itself take part in the heating by being itself heated by conventional heating resistors (not shown). It is also possible to ascertain that the planned temperature of the active surface 13 is reached by checking the corresponding elongation of the length Lo or the width lo of the active surface 13. Thus, for example, if the mechanical tension desired for the mask 12 corresponds to raising its temperature by 200° C., it can be ascertained that the length Lo, parallel to the first axis X, is increased by 0.50 mm., i.e. by 0.25 mm. on either side of the active surface 13 with respect to the second axis Y. This can be done in a simple way by using one or more position sensors (the use of which is known per se) such as, for example, a position sensor of the opto-electronic type comprising a transmitter and a receiver 52, 53 placed so as to give a signal when an internal edge or edges 54 of one positioning hole or holes 28 reaches or reach the vicinity of a positioning rod 48. One or more different holes (not shown) can also be used for this purpose.

During the stage when the mask 12 is heated, the frame 14 is kept in a low position, i.e. at a distance from the first strip 17 in order to prevent it from subjecting the said first strip 17 to the heat produced by the heating device 41.

It is necessary to avoid a heating of the frame 14, which could alter its dimensions and could modify the value of the mechanical tension planned for the active surface 13 during the cooling of the frame 14. A rise in the temperature of the frame 14, if any, may also be taken into account when determining the mechanical tension of the mask 12.

It must be noted that, during the functioning of the tube 1, the frame 14 is also heated. Since its mass is greater than that of the mask 12, its expansion may affect the tension of the mask in either direction. Thus, for example, at the start of functioning, the increase in the temperature of the frame 14, although slower than that of the mask 12, causes it to expand and consequently causes an increase in its dimensions. This tends to increase the tension of the mask 12 while, at the same time, conversely, the rise in the temperature of the mask 12 tends to reduce the mechanical tension said mask. By contrast, if we consider, for example, a period that follows a stoppage in functioning, the mask 12 cools down far quicker than the frame 14 and tends to recover its initial mechanical tension to which an additional mechanical tension is then added from the frame 14 which is still expanded. Consequently, it is useful to define a value of the initial mechanical tension of the mask 12 or active surface 13 that takes this phenomenon into account so that the increase in the active surface 13 remains within the limits of an elastic deformation.

When the desired temperature of the active surface 13 is reached, the jacks 47 place the frame 14 in contact with the internal surface 57 of the first strip 17. Immediately afterwards, the first strip 17 is welded (by either spot welding or seam welding) to the frame 14. The strip 17 can be welded to the frame 14 according to various methods known per se such as, for example, laser welding. Several welding devices 60 may be used simultaneously to do this welding more quickly.

The mask 12 having thus been fixed to the frame 14, it acquires the planned mechanical tension in cooling down, and the frame/mask assembly 14-12 has high mechanical rigidity which makes it easy to handle. In the non-limiting example described, the frame 14 is made of steel. It has a weight of about 0.5 kg. and a square-shaped solid section, the sides 61 of which have a length of 10 mm. However, within the spirit of the invention, the frame 14 may also have a differently shaped section: it may be hollow, for example, or open.

After the mask 12 has cooled down, the external strip 18 is separated from the mask 12 by means of the perforations 19, mentioned above, which are made beforehand so that it can be detached.

Figure 4:
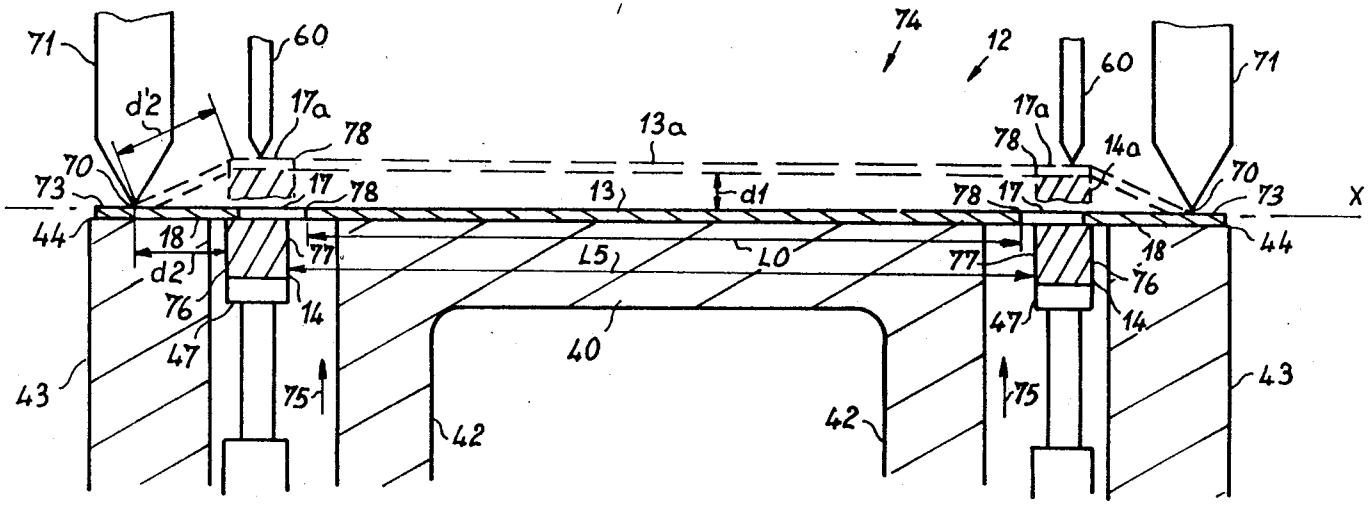
FIG. 4 gives a schematic cross-section view of a second embodiment of the method of the invention to fix the mask to a frame.

FIG. 4 shows the mask 12 in a cross-section along the first axis X and illustrates another version of the method of the invention which can be used for the temporary deformation of the active surface 13 through a purely mechanical action. This mechanical action consists in immobilizing the mask 12 in an initial plane by fixing it on its periphery, i.e. through the external strip 18, and then in pushing the frame 14 against the first strip 17 until the plane of the active surface 13 is shifted and brought into a plane parallel to the initial plane so as to create the desired mechanical tension, and then in welding the first strip 17 to the frame 14.

In the non-limiting example described, the mask 12 is positioned on the support 40 as in the previous example, for example, but unlike the previous case, the external strip 18 is applied with force along its entire periphery on the upper part 44 of the second columns 43 under the pressure exerted by mechanical pressure-applying elements 71, known per se.

The external strip 18 thus comprises fixing points 70 formed between the second columns 43 and the pressure-applying elements 71 and, opposite the first strip 17, it has an external part 73 which is designed to remain fixed, i.e. to remain in the initial positioning plane of the mask 12. An internal part 74 of the mask 12, extending between the fixing points 70, constitutes an extensible surface 74 designed to be deformed within the limits of its elasticity so as to give the active surface 13 the desired mechanical tension.

To this end, the frame 14 is pushed by means of jacks 47 against the first strip 17 in the direction shown by the arrows 75, and the first strip 17 and the active surface 13 are displaced in a second plane, known as the plane under tension, parallel to the plane of their initial positioning. The active surface 13, the first strip 17 and the frame 14 are shown in FIG. 4 in this new position where they are respectively marked **13*a*, 17*a* and 14*a*. The frame 14 is partially represented for the greater clarity of the figure. Assuming that the increase in the extensible surface 74 is uniform, it then has a mechanical tension which is substantially the same as that of the active surface 13*a*** and which is related to the distance d1 between the initial plane and the plane under tension.

The elongation of the extensible surface 74 corresponds, parallel to the first axis X for example, to the increase of a second distance d2 between the fixing points 70 and an external edge 76 of the frame 14 between the instant when the entire mask 12 is in the initial plane and the instant when the active surface 13 and the first strip 17 are off-set in the planes under tension. The second distance d2 is then marked d'2 in FIG. 4. It must be noted that a particularly simple way to obtain the desired mechanical tension of the active surface 13 consists in using the frame 14 itself, by giving it appropriate dimensions between its internal edges 77. Thus, for example, the frame 14 may comprise, between its internal edges 77, a length L5 which is greater than the length Lo of the active surface 13. The difference between these two lengths L5, Lo corresponds to the elongation $\Delta/L$ needed to obtain the desired mechanical tension $\sigma'$. It suffices then to push the frame 14 against the first strip 17 until the instant when the limits 78 of the active surface 13 coincide with the internal edges 77 of the frame 14.

The thrust of the frame 14 on the first strip 17 is interrupted when the mechanical tension desired for the active surface 13 is obtained, and the frame 14 and the first strip 17 are then welded to each other by welding devices 60.

The external strip 18 having been separated from the frame/mask assembly 14, 12, the latter can then be used to make the screen 9 which is formed on the internal surface of the envelope 6 as mentioned above.

Figure 6:
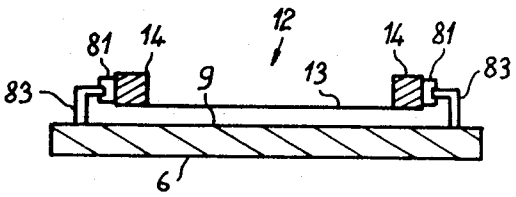
FIGS. 5 and 6 each give a schematic cross-section view of a stage in the method of the invention wherein the frame/mask assembly is joined to a front envelope shown in FIG. 1.
Figure 5:
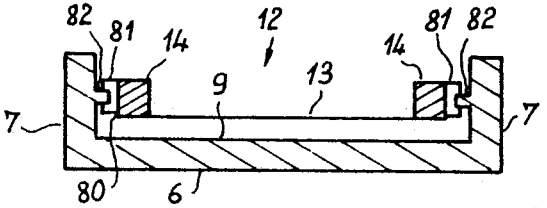

The FIGS. 5 and 6 are cross-section views of the frame/mask assembly 14, 12 and the envelope 6. They respectively illustrate non-limiting examples of the fixing of the frame/mask assembly 14, 12 for an envelope provided with a skirt 7 as shown in FIG. 1 and for an envelope 6 which has no skirt or where this fixing is done directly on the envelope 6.

In either of these cases, this fixing can be done by fixing elements, conventional per se consisting, for example, firstly, of three or four fixing lugs 81 joined to the frame 14 at the corners 80 of this said frame as mentioned earlier, and secondly, of studs 82, 83 joined to the glass of the skirt 7 or else to the glass of the envelope 6. Each stud 82, 83 is engaged in a fixing lug 81.

In the example shown in FIG. 5, where the envelope 6 comprises a skirt 7, the first studs 82 are straight and joined to the skirt 7.

In the case shown in FIG. 6, where the envelope 6 comprises no skirt, the second studs 83 are joined to the envelope 6 itself, and are bent in order to be engaged in the fixing lugs 81.

The fixing lugs 81 may be conventional leaf springs, for example, or springs of the bi-metal type as described, for example, in the French patent applications published under the Nos. 2 039 884 and 2 035 074.

Thus, it is possible to obtain in a simple way, a precise positioning of the frame/mask assembly 14, 12, with respect to the screen 9 formed on the inner side of the envelope 6 and to easily separate the frame/mask assembly 14, 12 from the envelope 6.

What is claimed is:

1. A method for mounting a shadow mask of the flat tension type in a trichromatic cathode tube wherein the mask is fixed to a frame and then the mask/frame assembly is mounted on the front envelope of the tube, the method comprising the steps of deforming said mask by mechanically stretching said mask so as to obtain an increase in an active surface of the mask, then fixing the mask in its state of deformation to the frame by welding so that the mask is held by the frame in a state of mechanical tension, wherein said deforming step comprises mechanically stretching the active surface of said mask by an amount at least equal to an increase in the active surface area arising during operation of the cathode ray tube.

2. A method according to the claim 1, including the step of checking the elongation of one dimension of the active surface, whereby a desired mechanical tension may be achieved.

3. A method according to the claim 1 wherein the frame is a metallic frame.

4. A method according to the claim 1 including the step of fixing the frame/mask assembly to the envelope by at least three fixing lugs joined to the frame, each working with a stud joined to a screen of the tube.

5. A trichromatic cathode tube comprising a front envelope and a flat tension mask mounted on a frame according to the method of claim 1, wherein the frame is a metallic frame.

6. A cathode tube according to the claim 5, comprising at least three fastening lugs joined to the frame, each lug working to fix the frame in cooperation with a fixing stud joined to the envelope.

7. A cathode tube according to the claim 6, wherein the envelope comprises a skirt, the said skirt being fitted with fixing studs.

8. A cathode tube according to the claim 6, wherein the studs are placed substantially adjacent the corners of the frame.

9. A method for mounting a shadow mask of the flat tension type in a trichromatic cathode tube wherein the mask is fixed to a frame and then the mask/frame assembly is mounted on the front envelope of the tube, the method comprising the steps of temporarily deforming said mask by mechanically stretching said mask so as to obtain an increase in an active surface of the mask, then fixing the mask in its state of deformation to the frame by welding so that the mask is held by the frame in a state of mechanical tension, wherein the mask comprises a first strip surrounding the active surface and includes an external detachable strip surrounding the first strip and wherein said step of temporarily deforming the mask comprises immobilizing the mask in an initial plane by fixing the external strip and then pushing the frame against the first strip until the active surface is shifted in a plane parallel to the initial plane.

10. A method according to claim 9, including the step of checking the elongation of one dimension of the active surface, whereby a desired mechanical tension may be achieved.

11. A method according to claim 9 wherein the frame is a metallic frame.

12. A method according to claim 9 including the step of fixing the frame/mask assembly to the envelope by at least three fixing lugs joined to the frame, each working with a stud joined to a screen of the tube.

13. A trichromatic cathode ray tube comprising a front envelope and a flat tension mask mounted on a frame according to the method of claim 9, wherein the frame is a metallic frame.

14. A cathode tube according to the claim 13, comprising at least three fastening lugs joined to the frame, each lug working to fix the frame in cooperation with a fixing stud joined to the envelope.

15. A cathode tube according to the claim 14, wherein the envelope comprises a skirt, the said skirt being fitted with fixing studs.

16. A cathode tube according to the claim 14, wherein the studs are placed substantially adjacent the corners of the frame.

* * * * *